US006594843B1

(12) United States Patent
Wilkins

(10) Patent No.: US 6,594,843 B1
(45) Date of Patent: Jul. 22, 2003

(54) PORTABLE CLEANING APPARATUS

(75) Inventor: Larry C. Wilkins, Georgetown, IN (US)

(73) Assignee: Electromechanical Research Laboratories, Inc., New Albany, IN (US)

( * ) Notice: Subject to any disclaimer, the term of this patent is extended or adjusted under 35 U.S.C. 154(b) by 0 days.

(21) Appl. No.: 09/438,863

(22) Filed: Nov. 12, 1999

(51) Int. Cl.[7] ..... A46B 13/06
(52) U.S. Cl. ..... 15/24; 15/29; 15/97.1
(58) Field of Search ..... 15/24, 29, 22.1, 15/97.1, 98; 4/606, 903

(56) References Cited

U.S. PATENT DOCUMENTS

| | | | | | |
|---|---|---|---|---|---|
| 518,352 | A | * | 4/1894 | Nightingale | 15/24 |
| 843,377 | A | * | 3/1907 | Kudrle et al. | 15/24 |
| 1,414,605 | A | * | 5/1922 | Tolookjian | 15/24 |
| 1,423,844 | A | * | 7/1922 | Fenelon | 15/24 |
| 1,817,644 | A | * | 8/1931 | Pope | 15/24 |
| 2,723,407 | A | * | 11/1955 | Bardon | 15/24 |
| 4,461,052 | A | | 7/1984 | Mostul | 15/29 |
| 4,581,785 | A | | 4/1986 | Suzuki | 15/21 |
| 4,780,922 | A | | 11/1988 | Sanchez | 15/29 |
| 5,146,642 | A | | 9/1992 | Mank et al. | 15/24 |
| 5,235,717 | A | | 8/1993 | Lanzo, Jr. et al. | 15/97.1 |
| 5,301,472 | A | | 4/1994 | Lyng | 51/180 |
| 5,987,682 | A | | 11/1999 | Rossi | 15/24 |

* cited by examiner

*Primary Examiner*—Gary K. Graham
(74) *Attorney, Agent, or Firm*—Woodard, Emhardt, Moriarty, McNett & Henry LLP

(57) ABSTRACT

A portable tool has a long handle with a fitting for connection to an external pressurized water supply, a hand receiver on the worker end of the handle with a trigger-operated water flow control valve, a rotatable wheel at a distal end of the handle remote from the control and having surface scrubbing elements thereon, a distribution nozzle pivotable in the handle adjacent the wheel to direct high velocity water discharge onto the scrubbing elements, a discharge direction control button adjacent the proximal end, and a control wire coupled to the nozzle and button and operable to direct discharge from the nozzle onto the wheel at selectable radii relative to the wheel rotational axis to change wheel speed, direction and torque.

56 Claims, 3 Drawing Sheets

PORTABLE CLEANING APPARATUS

BACKGROUND OF THE INVENTION

1. Field of the Invention

This invention relates generally to cleaning and beautifying equipment, and more particularly to portable machines for cleaning and beautifying exterior surfaces.

2. Description of Prior Art

More than 20 years ago, a device was marketed to help an individual wash an automobile. It included a brush fixed at one end of a long handle, and a garden hose connection at the other end of the handle. The brush was circular and had an open center. In the center, there was a wheel with a brush on it and which was propelled by water flowing from the garden hose through the handle to the brush. But as soon as the brush hit the surface to be washed, it would stop rotating, and was no more effective than the fixed brush around it. Therefore, it is an object of the present invention to provide an improved scrubbing apparatus.

SUMMARY OF THE INVENTION

Described briefly, the illustrated embodiment of the invention includes: a handle with a fitting for connection to an external pressurized water supply; a hand receiver on the handle with a water flow control; a rotatable wheel at an end of the handle remote from the control and having surface scrubbing elements thereon; a distribution nozzle moveable in the handle to direct high velocity of water discharge onto the wheel; and a discharge direction control associated with the nozzle and operable to direct discharge from the nozzle onto the wheel at selectable radii relative to the wheel rotational axis for wheel speed, direction and torque control.

DESCRIPTION OF THE ILLUSTRATED EMBODIMENT

Figure 1:
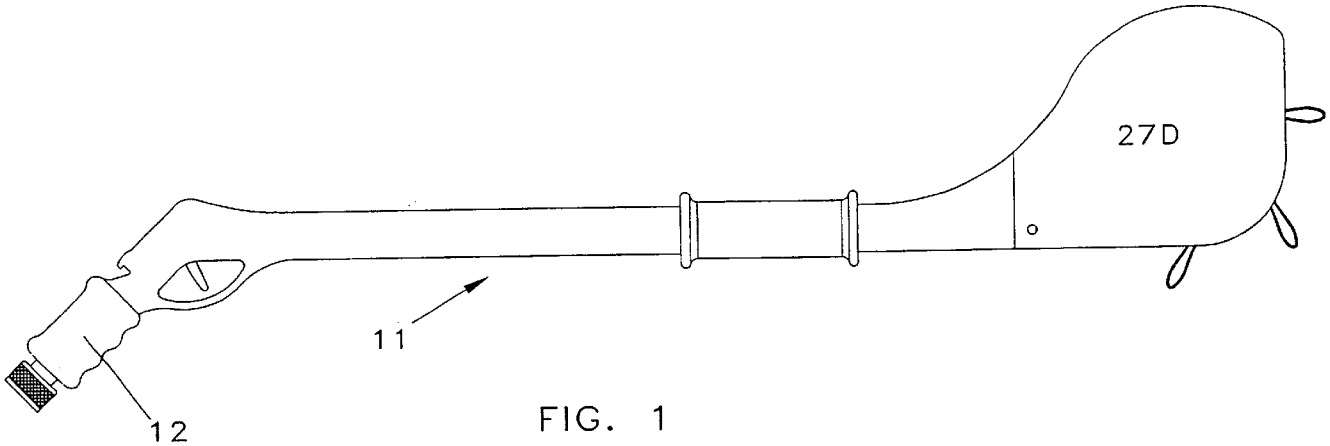
FIG. 1 is a side elevational view of a typical embodiment of the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the scrubber includes a handle 11 having a hand grip 12 at one end and a scrubbing wheel 13 at the other end. A hose connector 14 at the proximal end provides for convenient attachment to a conventional garden hose 16 whereby water may be supplied under pressure from the garden hose through the tube 17 to valve 18, operable by the trigger 19 protected by trigger guard 20. The valve is normally closed but can be opened by moving the trigger in the direction of arrow 21 about the pivot axis 22 to open the valve to any desired degree.

A tube 23 extends from the downstream side of valve 18 to a nozzle 24 pivotally mounted at 26 to the handle housing 27 so that it can be pivoted from the solid line position shown to the dotted line position 24A.

In order to pivot the nozzle, a bowden cable arrangement is provided. This includes the cable sleeve 28 fixed in the housing 27 at the proximal end 29 of the cable, and at the distal end 31 as by a clamp 32, for example. The cable 33 inside the tube and linearly moveable relative to the tube 28 is pinned or hooked at 34 to the distal end of the nozzle and is pinned or hooked at the proximal end of the cable 36 to a direction, speed and torque control slider button 37.

Figure 2:
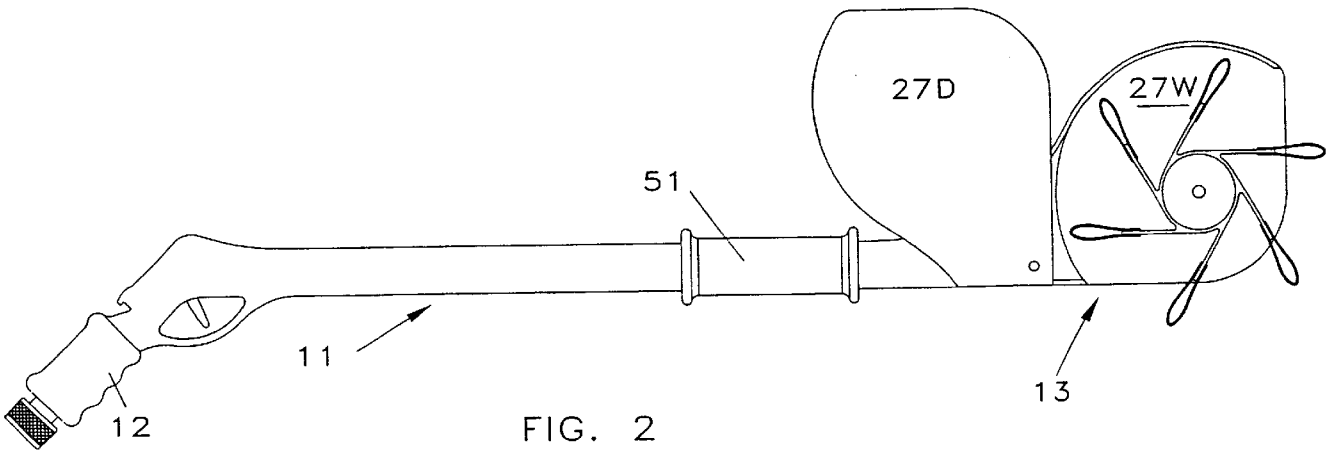
FIG. 2 is a view like FIG. 1 but showing the wheel-access door open.
Figure 3:
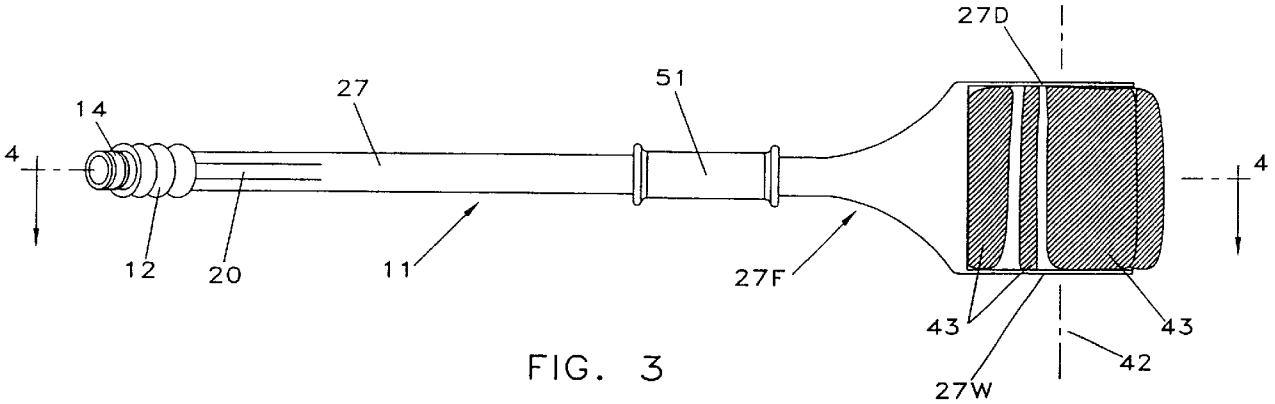
FIG. 3 is a bottom plan view.
Figure 4:
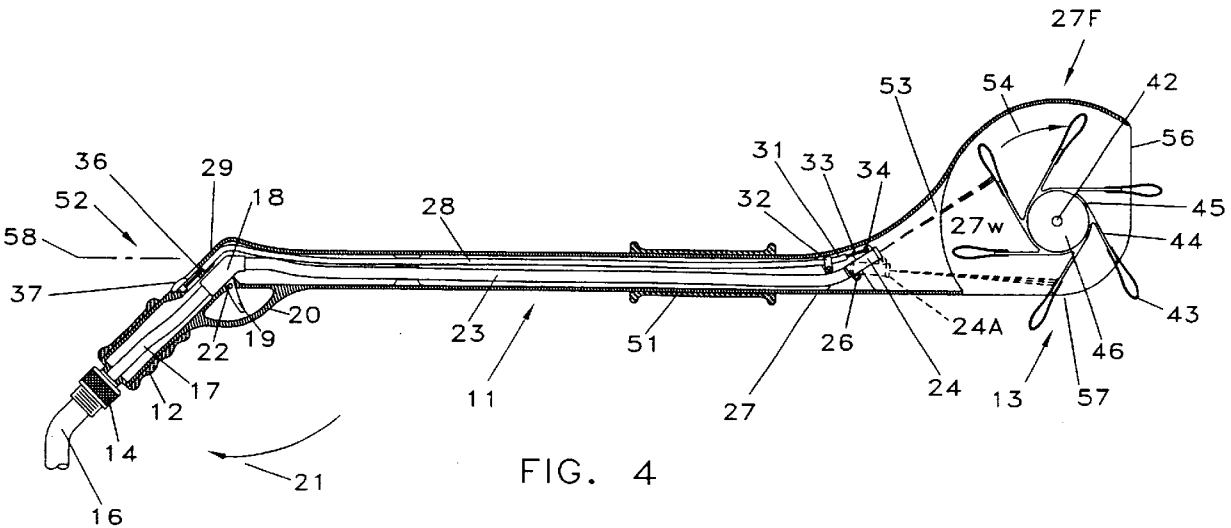
FIG. 4 is a section taken at line 4—4 in FIG. 3 and viewed in the direction of the arrows.
Figure 5:
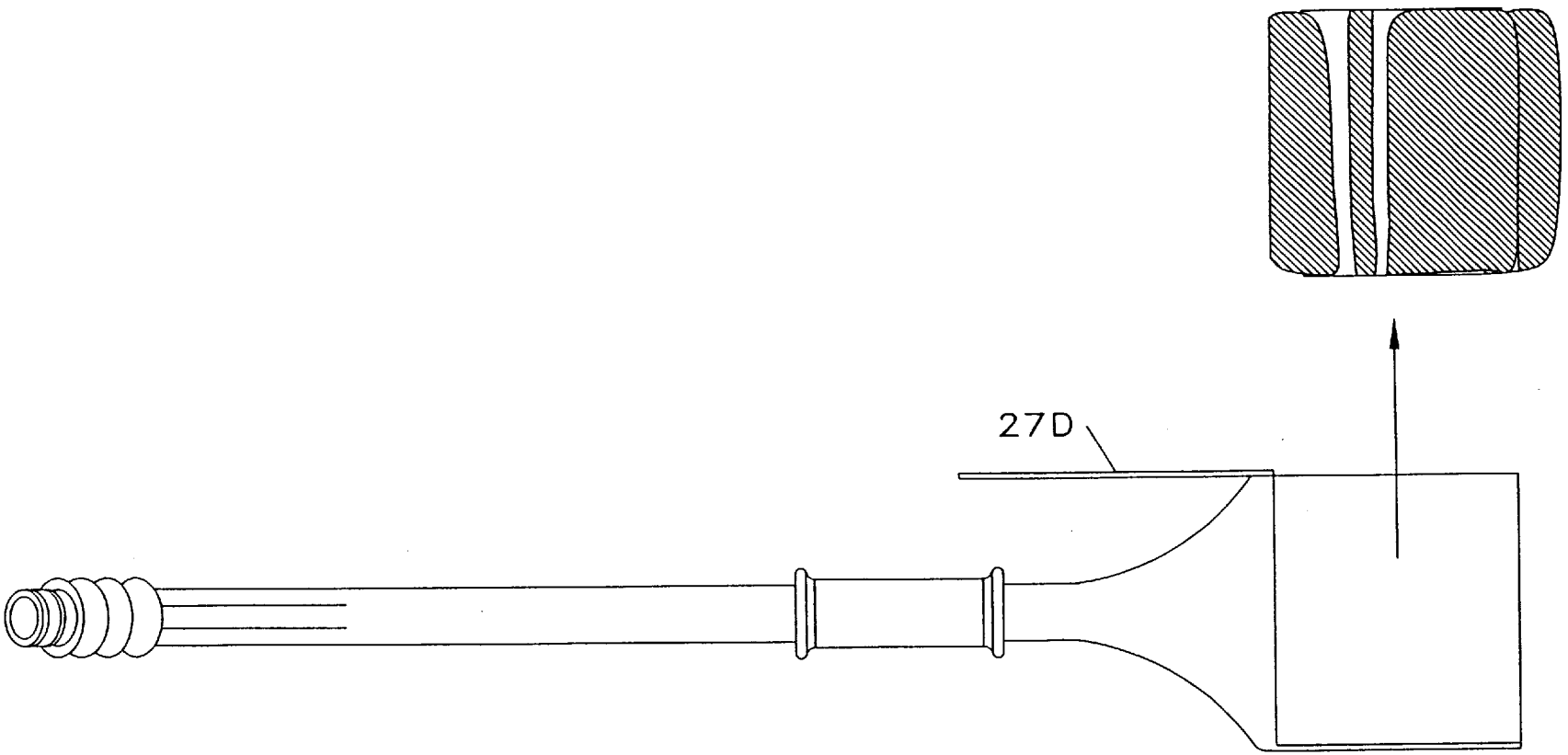
FIG. 5 is a bottom plan view like FIG. 3 but showing the access door open and the cleaning element sleeve removed from the mounting hub.

The scrubber wheel 13 is rotatably mounted in the flared portion 27F of the housing for rotation on an axle 41 which has one end fixed in the housing wall 27W whereby the wheel is cantilever-mounted to the housing wall and is rotatable about the axis 42. Scrubbing elements in the form of wash cloth material or brush material 43, for example, are mounted on the wheel. In the illustrated embodiment, each such element is mounted to a support in the form of a semi-rigid molded plastic blade 44 which is a molded portion of a sleeve 45 which is slidably mounted on the wheel hub 46. Each scrubbing element projects outward generally on a line tangent cylindrical exterior surface portion of the sleeve. The scrubbing elements may be an integral part of this molded unit if they have sufficient durability to work against the surface to be scrubbed while, at the same time, being sufficiently soft or compliant to avoid damage to the surface being scrubbed. The elements 43 may be expendable units which may be clipped, pinned, snapped-onto, or otherwise mounted on the distal ends of blades 44 for replacement when desired in response to wear or in response to the need for a different type of element for a different type of application of the tool or for use on a different type of work surface to be treated by the tool. However it is more likely that the entire sleeve will be expendable such that, when elements become worn, or a different type is needed. the entire sleeve 45 may be removed from the hub. To do this, the housing wall door 27D is swung up about the hinge to the position shown in FIGS. 2 and 5, and the sleeve 45 is removed in the direction of the arrow in FIG. 5.

Operation

In the use of the apparatus, it may first be connected to the garden hose 16 with the connector 14. Then the garden hose is turned on. The valve 18 is normally closed. The user, with one hand on the grip 12 and the other hand on the sleeve grip 51 may then open the valve 18 slightly by pulling the trigger 19 and, with the direction control button 37 toward the lower limit of its movement in the direction of arrow 52, the direction of water discharge 53 from the nozzle strikes the applicator elements 43 to rotate the wheel in the clockwise direction of arrow 54. The trigger can be pulled further in the direction of arrow 21 to increase the flow rate through the tube 23 and nozzle to increase the energy applied to the wheel. Accordingly with the nozzle directed as shown, the speed of the wheel will increase. Also, the torque applied to the wheel will increase. If it is desired to increase the speed of the wheel, with attendant reduction in available torque, the adjustment button can be moved upward in the direction opposite arrow 52 whereupon the nozzle will be pivoted downward about the axis 26 and discharge the water onto the wheel closer to the axis of rotation of it. Continued movement of the button toward the upper limit of its available travel will move the nozzle discharge direction downward past the rotational axis 42 and ultimately to the lower discharge direction when the nozzle is at the dotted line position of 24A. During this transition, the speed of the wheel will decrease and reverse so that it is turning in the opposite (to arrow 54) direction for counterclockwise rotation.

It is expected that, for most uses, the orientation of the nozzle will be in the direction shown by the solid lines in the drawing. Accordingly, the housing is flared upward relative to the longitudinal axis 58 of the handle, opposite the downward direction of the handgrip 12. Therefore, because both of the walls 27W and 27D cover most of the projected area of the sides of the wheel, they prevent side spray or backward spray toward the worker, thus making most effective use of the focused direction of the nozzle discharge onto the scrubber elements. Consequently, the spray and the scrubber elements are applied to the surface being scrubbed, without spray back onto the worker, and enabling the worker to see the surface being treated. Of course, the width of the wheel and particularly, the scrubbing elements 43 and paddle blades 44 on which they are fastened and measured in a direction parallel to the rotational axis 42, will depend upon the desired size of the apparatus, the water pressure and volume of water available. The overall length from grip 12 to wheel can be such as desired for the particular application, and the convenience of the worker. It is expected that the width of elements 43 in a direction parallel the axis 42 would be from two to twenty-four inches. The overall length of handle from end-to-end is expected to be between two feet and six feet, again depending on the application. It could easily be up to six feet or more for floor or wall scrubbing. Also, the sleeve 51 may be slidable longitudinally along the housing 27 to facilitate the size of the worker and the nature of the task.

It is useful to construct the hub 46 much like a conventional painting roller, with plastic spools on opposite ends and five circularly-spaced wires connected to and extending between the spools and on which the sleeve 45 is slidably mounted. The spools are rotatably mounted on the axle. Other constructions for the hub and sleeve may be used.

Various materials of construction may be used. The housing may be made of metal or plastic for example, and portions of the housing which may inadvertently contact a fragile or decorative surface may be edged with a soft protective material such as soft plastic or soft rubber such as at the distal edge 56 and bottom edge 57 of the wheel housing portion.

Also, the tool could be supplied with liquid other than water and from other than a garden hose. It could be used for surface treatment other than scrubbing. Wet sanding or polishing are two possible examples.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. Portable apparatus for treating a surface and comprising:

a handle;

an inlet on said handle for a liquid supply device;

a wheel mounted to said handle for rotation relative to said handle;

surface treatment portions about said wheel;

a nozzle mounted on said handle and coupled to said inlet to deliver to said treatment portions, liquid received from a supply device when connected to said inlet, to drive said treatment portions and thereby drive said wheel in rotation relative to said handle; and a delivery direction control device coupled to said nozzle and mounted on said handle remote from said wheel, said nozzle being moveable with said delivery direction control device such that the direction of said delivery of liquid is changeable relative to said wheel to deliver liquid to said treatment portions at selectable angles.

2. The apparatus of claim 1, further comprising a liquid flow rate control device on said handle to control the amount of liquid delivered to said treatment portions.

3. The apparatus of claim 1 and wherein:

said nozzle is movable relative to said wheel to change said direction of said delivery.

4. The apparatus of claim 3 and wherein:

said nozzle is pivotally mounted to said handle.

5. The apparatus of claim 4 and further comprising:

a nozzle direction control device on a part of said handle and coupled to said nozzle to pivot said nozzle from said handle.

6. The apparatus of claim 1 and wherein:

said wheel has a hub portion; and said surface treatment portions are flexible and are coupled to said hub portion.

7. The apparatus of claim 1 and wherein:

said handle has a longitudinal axis, with a hand grip at a proximal end and a flared portion at the distal end, said hand grip projecting downward from said axis, and said flared portion projecting upward from said axis and shrouding a substantial area above and at the sides of said wheel.

8. The apparatus of claim 7 and wherein:

said connector is at a proximal end of said hand grip and adapted to connect to a supply device in the form of a garden hose; and a nozzle control device is located adjacent said grip;

a liquid flow trigger is located adjacent said grip; and said treatment portions move in a circular path from locations inside said flared portion to a location exposed at the distal end where unshrouded above and at the sides.

9. Portable apparatus for treating a surface and comprising:

a handle;

an inlet on said handle for a liquid supply device;

a wheel mounted to said handle for rotation relative to said handle, wherein said wheel has a hub portion and a sleeve slidably received axially on said hub portion with surface treatment portions comprising discrete flexible pieces connected to said sleeve; and a nozzle mounted on said handle and coupled to said inlet to deliver to said treatment portions, liquid received from a supply device when connected to said inlet, to drive said treatment portions and thereby drive said wheel in rotation relative to said handle.

10. The apparatus of claim 9 and wherein:

said sleeve has blades circularly spaced about a rotational axis of said wheel; and said flexible pieces are attached to distal ends of said blades.

11. The apparatus of claim 9 and wherein:

an axle is mounted to a portion of said handle; and said hub portion is mounted for rotation on said axle.

12. The apparatus of claim 11 and wherein:

said axle is cantilever fixed to said handle.

13. The apparatus of claim 11 and wherein:

said handle includes a housing substantially shielding said wheel;

said housing having two sides at sides of said wheel;

said axle being fixed to one of said sides; and the other of said sides being movable on said handle to expose one of said sides of said wheel to facilitate installation and removal of said sleeve on said hub portion.

14. The apparatus of claim 13 and wherein:

the said other side is a hinged door.

15. The apparatus of claim 9 and wherein:

said hub portion has blades circularly spaced about a rotational axis of said wheel; and said flexible pieces are attached to distal ends of said blades.

16. The apparatus of claim 15 and wherein:

said flexible pieces are removable from said blades for replacement.

17. The apparatus of claim 9 and wherein:

said handle has a longitudinal axis, with a hand grip at a proximal end and a flared portion at the distal end, said hand grip projecting downward from said axis, and said flared portion projecting upward from said axis and shrouding a substantial area above and at the sides of said wheel.

18. The apparatus of claim 17 and wherein:

a connector is at a proximal end of said hand grip and adapted to connect to a supply device in the form of a garden hose; and a nozzle control device is located adjacent said grip;

a liquid flow trigger is located adjacent said grip; and said treatment portions move in a circular path from locations inside said flared portion to a location exposed at the distal end where unshrouded above and at the sides.

19. Portable apparatus for treating a surface and comprising:

a handle;

an inlet on said handle for a flexible liquid-supply device;

a wheel mounted to said handle for rotation relative to said handle;

surface treatment portions about said wheel; and a nozzle mounted on said handle and coupled to said inlet to deliver to said treatment portions, liquid received from a supply device when connected to said inlet, to drive said treatment portions and thereby drive said wheel in rotation relative to said handle, wherein said nozzle is movable relative to said handle as liquid is delivered therethrough and wherein said nozzle is pivotally mounted on said handle.

20. The device of claim 19, and wherein said nozzle is movable to change a direction of rotation of said wheel.

21. The apparatus of claim 19 and further comprising:

a liquid flow rate control device on said handle to control the amount of liquid delivered to said treatment portions.

22. The apparatus of claim 19 and wherein:

said nozzle is moveable such that the direction of said delivery of liquid is changeable relative to said wheel to deliver liquid to said treatment portions at selectable angles.

23. The apparatus of claim 22 and further comprising:

a delivery direction control device coupled to said nozzle and mounted on said handle remote from said wheel.

24. The apparatus of claim 23 and wherein:

said nozzle is movable relative to said wheel to change said direction of said delivery.

25. The apparatus of claim 22 and further comprising:

a nozzle direction control device on a part of said handle and coupled to said nozzle to pivot said nozzle on said handle.

26. The apparatus of claim 19 and wherein:

the wheel has a hub portion; and the surface treatment portions are flexible and are coupled to the hub portion.

27. The apparatus of claim 26 and wherein:

the wheel includes a sleeve slidably received axially on said hub portion; and said treatment portions are discrete flexible pieces connected to said sleeve.

28. The apparatus of claim 26 and wherein:

said sleeve has blades circularly spaced about a rotational axis of the wheel; and the flexible pieces are attached to distal ends of the blades.

29. The apparatus of claim 26 and wherein:

an axle is mounted to a portion of said handle;

said hub portion is mounted for rotation on said axle; and the wheel includes a sleeve slidably received axially on said hub portion.

30. The apparatus of claim 29 and wherein:

said axle is cantilever fixed to said handle.

31. The apparatus of claim 29 and wherein:

said handle includes a housing substantially shielding said wheel;

said housing having two sides at sides of said wheel;

said axle being fixed to one of said sides; and the other of said sides being movable on said handle to expose one of said sides of said wheel to facilitate installation and removal of said sleeve on said hub.

32. The apparatus of claim 31 and wherein:

the said other side is a hinged door.

33. The apparatus of claim 26 and wherein:

the hub portion has blades circularly spaced about a rotational axis of the wheel; and the flexible pieces are attached to distal ends of the blades.

34. The apparatus of claim 33 and wherein:

the pieces are removable from the blades for replacement.

35. The apparatus of claim 19 and wherein:

said handle has a longitudinal axis, with a hand grip at a proximal end and a flared portion at the distal end, the hand grip projecting downward from said axis, and the flared portion projecting upward from said axis and shrouding a substantial area above and at the sides of said wheel.

36. The apparatus of claim 35 and wherein:

a connector is at a proximal end of said hand grip and adapted to connect to a supply device in the form of a garden hose; and a nozzle control device is located adjacent said grip; and a liquid flow trigger is located adjacent said grip; and said treatment portions move in a circular path from locations inside said flared portion to a location exposed at the distal end where unshrouded above and at the sides.

37. Portable apparatus for treating a surface and comprising:

a handle;

an inlet on said handle for a liquid supply device;

a wheel mounted to said handle for rotation relative to said handle, wherein the wheel has a hub portion with blades circularly spaced about a rotational axis of the wheel and with surface treatment portions coupled to distal ends of said blades; and a nozzle mounted on said handle and coupled to said inlet to deliver to said treatment portions, liquid received from a supply device when connected to said inlet, to drive said treatment portions and thereby drive said wheel in rotation relative to said handle; and a delivery direction control device coupled to said nozzle and mounted on said handle remote from said wheel.

38. The apparatus of claim 37, wherein said surface treatment portions are discrete flexible pieces.

39. The apparatus of claim 38, wherein said pieces are removable from said blades for replacement.

40. The apparatus of claim 37 and wherein:

an axle is mounted to a portion of said handle;

said hub portion is mounted for rotation on said axle; and said wheel includes a sleeve slidably received axially on said hub portion.

41. The apparatus of claim 37, wherein said nozzle is pivotal relative to said handle.

42. The apparatus of claim 37 and wherein:

said nozzle is moveable such that the direction of said delivery of liquid is changeable relative to said wheel to deliver liquid to said treatment portions at selectable angles.

43. The apparatus of claim 37 and further comprising:

said delivery direction control device adapted to pivot said nozzle on said handle.

44. The apparatus of claim 37, wherein said nozzle is moveable to change a direction of rotation of said wheel.

45. Portable apparatus for treating a surface and comprising:

a handle;

an inlet on said handle for a flexible liquid-supply device;

a wheel mounted to said handle for rotation relative to said handle;

surface treatment portions about said wheel;

a nozzle mounted on said handle and coupled to said inlet to deliver to said treatment portions, liquid received from a supply device when connected to said inlet, to drive said treatment portions and thereby drive said wheel in rotation relative to said handle, wherein said nozzle is movable relative to said wheel to vary a rotational speed of said wheel as liquid is delivered to said treatment portions; and a delivery direction control device coupled to said nozzle and mounted on said handle remote from said wheel.

46. The apparatus of claim 45, wherein said nozzle is pivotal relative to said handle.

47. The apparatus of claim 45 and wherein:

said nozzle is moveable such that the direction of said delivery of liquid is changeable relative to said wheel to deliver liquid to said treatment portions at selectable angles.

48. The apparatus of claim 45 and further comprising:

said delivery direction control device adapted to pivot said nozzle on said handle.

49. Portable apparatus for treating a surface and comprising:

a handle;

an inlet on said handle for a flexible liquid-supply device;

a wheel mounted to said handle for rotation relative to said handle;

surface treatment portions about said wheel; and a nozzle mounted on said handle and coupled to said inlet to deliver to said treatment portions, liquid received from a supply device when connected to said inlet, to drive said treatment portions and thereby drive said wheel in rotation relative to said handle, wherein said nozzle is movable relative to said wheel to vary a rotational direction of said wheel as liquid is delivered to said treatment portions, wherein said nozzle is pivotal relative to said handle.

50. The apparatus of claim 49 and wherein:

said nozzle is moveable such that the direction of said delivery of liquid is changeable relative to said wheel to deliver liquid to said treatment portions at selectable angles.

51. The apparatus of claim 49 and further comprising:

a delivery direction control device coupled to said nozzle and mounted on said handle remote from said wheel.

52. The apparatus of claim 49 and further comprising:

a nozzle direction control device on a part of said handle and coupled to said nozzle to pivot said nozzle on said handle.

53. Portable apparatus for treating a surface and comprising:

a handle;

an inlet on said handle for a flexible liquid-supply device;

a wheel mounted to said handle for rotation relative to said handle;

surface treatment portions about said wheel; and a nozzle mounted on said handle and coupled to said inlet to deliver to said treatment portions, liquid received from a supply device when connected to said inlet, to drive said treatment portions and thereby drive said wheel in rotation relative to said handle, wherein said nozzle is movable relative to said wheel to vary a rotational direction of said wheel as liquid is delivered to said treatment portions; and a delivery direction control device coupled to said nozzle and mounted on said handle remote from said wheel.

54. The apparatus of claim 53, wherein said nozzle is pivotal relative to said handle.

55. The apparatus of claim 53 and wherein:

said nozzle is moveable such that the direction of said delivery of liquid is changeable relative to said wheel to deliver liquid to said treatment portions at selectable angles.

56. The apparatus of claim 53 and further comprising:

said delivery direction control device adapted to pivot said nozzle on said handle.

* * * * *